US005449041A

United States Patent [19]

Galbraith

[11] Patent Number: 5,449,041

[45] Date of Patent: Sep. 12, 1995

[54] APPARATUS AND METHOD FOR SUPPRESSING A FIRE

[75] Inventor: Lyle D. Galbraith, Redmund, Wash.

[73] Assignee: Olin Corporation, Redmond, Wash.

[21] Appl. No.: 82,137

[22] Filed: Jun. 24, 1993

[51] Int. Cl.[6] ..... A62C 35/13

[52] U.S. Cl. ..... 169/11; 169/7; 169/9; 169/26; 169/27; 169/61; 169/62; 169/84; 102/290

[58] Field of Search ..... 169/5, 6, 7, 8, 9, 11, 169/12, 26, 27, 28, 30, 71, 72, 78, 84, 85, 35, 43, 44, 45, 46, 47, 60, 61, 62; 252/2, 3, 4, 5, 6, 7, 8; 149/19.6, 35, 36, 61, 77; 102/290

[56] References Cited

U.S. PATENT DOCUMENTS

| | | | |
|---|---|---|---|
| 798,142 | 8/1905 | Myers | 169/77 |
| 1,119,799 | 12/1914 | Bowman | 169/26 |
| 1,648,397 | 11/1927 | Hermann | 169/26 |
| 2,530,633 | 11/1950 | Scholz | 169/26 |
| 2,838,122 | 6/1958 | Hutchinson | 169/84 |
| 3,714,047 | 1/1973 | Marion et al. | 102/290 X |
| 3,785,674 | 1/1974 | Poole et al. | 280/741 |
| 3,797,854 | 3/1974 | Poole et al. | 280/741 |
| 3,880,447 | 4/1975 | Thorn et al. | 280/740 |
| 3,901,747 | 8/1975 | Garner | 149/42 |
| 3,904,221 | 9/1975 | Shiki et al. | 280/736 |
| 3,924,688 | 12/1975 | Cooper et al. | 169/61 |
| 4,194,571 | 3/1980 | Monte | 169/9 X |
| 4,274,491 | 6/1981 | Tarpley et al. | 169/46 |
| 4,276,938 | 7/1981 | Kllimenko et al. | 169/47 |
| 4,319,640 | 3/1982 | Brobeil | 169/9 X |
| 4,532,996 | 8/1985 | Wilson et al. | 169/23 |
| 4,601,344 | 7/1986 | Reed, Jr. et al. | 169/47 |
| 4,601,862 | 7/1986 | Byrd et al. | 102/290 X |
| 4,637,472 | 1/1987 | Decima | 169/28 X |
| 4,889,189 | 12/1989 | Roznieki | 169/73 |
| 4,915,853 | 4/1990 | Yamaguchi | 252/2 |
| 5,035,757 | 7/1991 | Poole | 149/61 X |

OTHER PUBLICATIONS

Gibbs. W. Wayt, "Extinguished "*Scientific American*, June 1993 vol. 268, No. 6, p. 136.

*The New Enclyclopedia Britannica*, vol. 19, Fifteenth Edition (1986) "Fire Prevention Control ", pp. 186–188.

Sheinson et al,, "HF and HBr Production From Full Scale, $CF_3Br$ (Halon 1301) Fire Suppression Tests"*The Journal of Fire & Flammability, vol. 12, (July 1981), pp. 229–235.*

Ling et al., "Fire Control in Aircraft: 1. Comparaive Testing in Some Dry Powder Chemical Extinguishants and a New Effective System", *The Journal of Fire & Flammability, vol. 13, (Oct. 1982), pp. 215–236).*

*Primary Examiner*—Andrew C. Pike

*Attorney, Agent, or Firm*—Gregory S. Rosenblatt

[57] ABSTRACT

An apparatus for suppressing a fire comprises a gas generator in communication with a vaporizable liquid by means of a first conduit. When activated, the gas generator generates an elevated temperature burst of a first gas containing carbon dioxide, nitrogen, and/or water vapor. This first gas vaporizes substantially all of the vaporizable liquid, generating a second gas having flame suppressing capabilities. The second gas is directed at the fire to suppress and extinguish it.

8 Claims, 2 Drawing Sheets

APPARATUS AND METHOD FOR SUPPRESSING A FIRE

BACKGROUND OF THE INVENTION

This invention relates to an apparatus and a method for suppressing a fire. More particularly, a gas generator produces an elevated temperature first gas which interacts with a vaporizable liquid to generate a second gas having flame suppressing capabilities.

Fire involves a chemical reaction between oxygen and a fuel which is raised to its ignition temperature by heat. Fire suppression systems operate by any one or a combination of the following: (i) removing oxygen, (ii) reducing the system temperature, (iii) separating tile fuel from oxygen, and (iv) interrupting the chemical reactions of combustion. Typical fire suppression agents include water, carbon dioxide, dry chemicals, and the group of halocarbons collectively known as Halons.

The vaporization of water to steam removes heat from the fire. Water is an electrical conductor and its use around electrical devices is hazardous. However, in non-electrical situations, when provided as a fine mist over a large area, water is an effective, environmentally friendly, fire suppression agent.

Carbon dioxide ($CO_2$) gas suppresses a fire by a combination of the displacement of oxygen and absorption of heat. Carbon dioxide gas does not conduct electricity and may safely be used around electrical devices. The carbon dioxide can be stored as compressed gels, but requires high pressure cylinders for room temperature storage. The cylinders are heavy and the volume of compressed gas limited. Larger quantities of carbon dioxide are stored more economically as a liquid which vaporizes when exposed to room temperature and atmospheric pressure.

When exposed to room temperature and atmospheric pressure, the expansion characteristics of liquid $CO_2$ are such that approximately one third of the vessel charge freezes during the blow down process. Only about two thirds of the $CO_2$ is exhausted in a reasonable time. The remainder forms a dry ice mass which remains in the storage vessel. While the dry ice eventually sublimes and exits the vessel, the sublimation period is measured in hours and is of little use in fire suppression.

The problem with liquid carbon dioxide based fire suppression systems is worse when low temperature operation is required. At −65° F., the vapor pressure of carbon dioxide is about 70 psig (compared to 700 psig at 70° F.) which is totally inadequate for rapid expulsion. The vessel freeze-up problem is worse. About 50% of the liquid carbon dioxide solidifies when exposed to −65° F. and atmospheric pressure.

Improved carbon dioxide suppression systems add pressurized nitrogen to facilitate the rapid expulsion of carbon dioxide gas at room temperature. The pressurized nitrogen does not resolve the freezing problem at low temperatures, and at upper service extremes, about 160° F., the storage pressure is extremely high, dictating the use of heavy thick, walled storage vessels.

Chemical systems extinguish a fire by separating the fuel from oxygen. Typical dry chemical systems include sodium bicarbonate, potassium bicarbonate, ammonium phosphate, and potassium chloride. Granular graphite with organic phosphate added to improve effectiveness, known as G-1 powder, is widely used on metal fires. Other suitable dry compounds include sodium chloride with tri-calcium phosphate added to improve flow, metal stearates for water repellency, dry sand, talc, asbestos powder, powdered limestone, graphite powder, and sodium carbonate. Dry chemical systems are delivered to a fire combined with a pressurized inert gas or manually such as with a shovel. The distribution system is inefficient for large fires and a significant amount of time is required to deliver an effective quantity of the dry powder to suppress a large fire.

The most efficient fire suppression agents are Halons. Halons are a class of halogenated hydrocarbons and are derived from saturated hydrocarbons, such as methane or ethane, with their hydrogen atoms replaced with atoms of the halogen elements bromine, chlorine, and/or fluorine. This substitution changes the molecule from a flammable substance to a fire extinguishing agent. Fluorine increases inertness and stability, while bromine increases fire extinguishing effectiveness. The most widely used Halon is Halon 1301, $CF_3Br$, trifluorobromomethane. Halon 1301 extinguishes a fire in concentrations far below the concentrations required for carbon dioxide or nitrogen gas. Typically, a Halon 1301 concentration above about 3.3% by volume will extinguish a fire.

Halon fire suppression occurs through a combination of effects, including decreasing the available oxygen, isolation of fuel from atmospheric oxygen, cooling, and chemical interruption of the combustion reactions. The superior fire suppression efficiency of Halon 1301 is due to its ability to terminate the runaway reaction associated with combustion. The termination step is catalytic for Halon 1301 due to the stability of bromine radicals (Br.) formed when Halon 1301 is disposed on a combustion source.

When unreacted Halon 1301 migrates into the stratosphere, sunlight breaks down the Halon 1301 forming bromine radicals. Br. then reacts to consume ozone in an irreversible manner.

$$Br. + O_3 \rightarrow BrO. + O_2$$

In view of the current recognition that ozone depletion is a serious environmental problem, a move is on to identify: (i) fire suppression agents having a less severe environmental impact than Halon and (ii) devices to deliver these more environmentally friendly agents.

SUMMARY OF THE INVENTION

Accordingly, it is an object of the invention to provide a fire suppression apparatus for effectively delivering a fire suppressant which is less environmentally hazardous than Halon. It is a feature of the invention that the apparatus effectively delivers both liquid and solid fire suppressants. It is an advantage of the invention that the apparatus does not require significantly more space than Halon fire suppression apparatus. A further advantage of the invention is that both high and low vapor pressure liquids are effectively stored, vaporized, and delivered in gaseous form.

In accordance with the invention, there is provided an apparatus for suppressing a fire. The apparatus contains a gas generator and a vaporizable liquid contained within a chamber. A passageway is provided between the chamber and a fire. When activated, the apparatus suppresses a fire by generating an elevated temperature first gas. A first liquid is substantially vaporized by interaction with the first gas generating a second gas having flame suppressing capabilities; the second gas is then directed at the fire.

In another embodiment of the invention, the first gas is an effective flame suppressant such as $CO_2$, $N_2$, or water vapor. The first gas may be used directly as a flame suppressant or combined with the second gas for flame suppression.

The above stated objects, features, and advantages will become more apparent from the specification and drawings which follow.

DETAILED DESCRIPTION OF THE DRAWINGS

Figure 1:
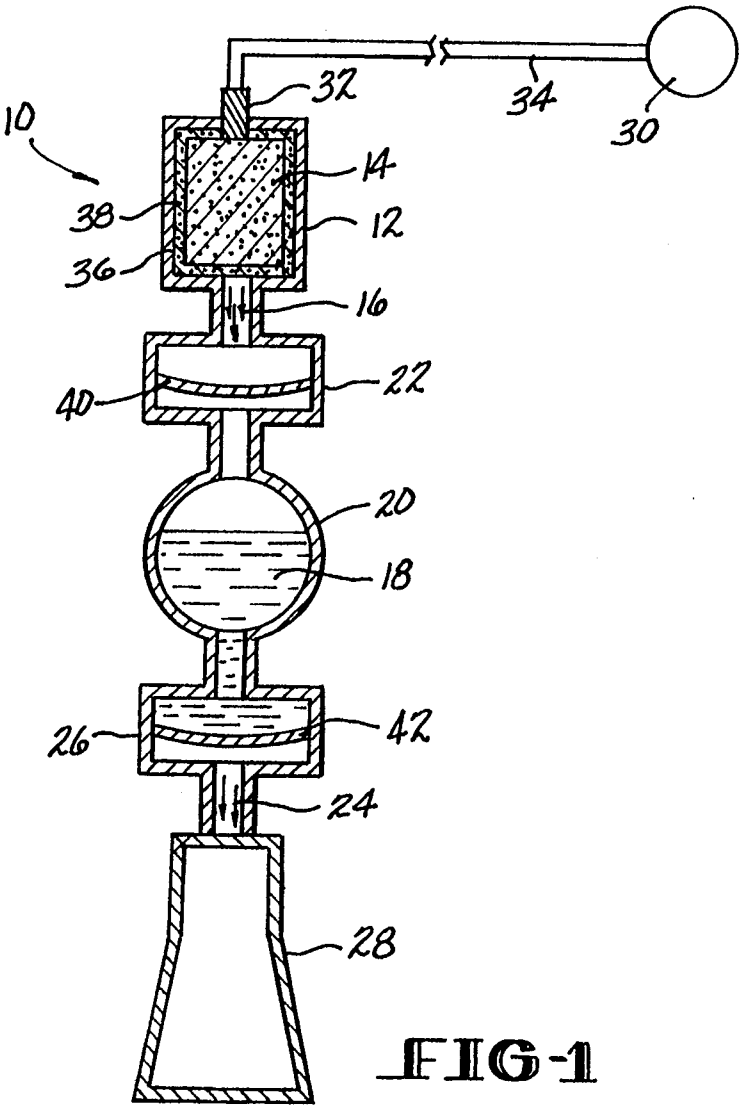
FIG. 1 illustrates in cross-sectional representation an apparatus for vaporizing a liquid to a flame suppressing gas in accordance with a first embodiment of the invention.

FIG. 1 shows in cross-sectional representation a fire suppression apparatus 10 in accordance with a first embodiment of the invention. A gas generator 12 containing a suitable solid propellant 14 delivers an elevated temperature first gas 16 to a vaporizable liquid 18 contained in a chamber 20. A first conduit 22 provides a passageway between the gas generator 12 and the chamber 20. The first gas 16 interacts with the vaporizable liquid 18 converting the liquid to a second gas 24. By proper selection of the vaporizable liquid 18, the second gas has flame suppressing capabilities. A second conduit 26 directs the second gas 24 to a fire. An optional aspirator 28 uniformly distributes the second gas 24 over a wide area.

The fire suppression apparatus 10 is permanently mounted in a ceiling or wall of a building, aircraft, or other suitable structure or vehicle. A sensor 30 detects the presence of a fire. Typically, the sensor 30 detects a rise in temperature or a change in the ionization potential of air due to the presence of smoke. On detecting a fire, the sensor 30 transmits an activating signal to a triggering mechanism 32. The activating signal may be a radio pulse, an electric pulse transmitted by wires 34, or other suitable means.

The triggering mechanism 32 is any device capable of igniting the solid propellant 14. One triggering mechanism is an electric squib. The electric squib has two leads interconnected by a bridge wire, typically 3–4 mil diameter nichrome. When a current passes through the leads, the bridge wire becomes red hot, igniting an adjacent squib mixture, typically, zirconium and potassium perchlorate. The ignited squib mixture then ignites an adjacent black powder charge, creating a fireball and pressure shock wave which ignites the solid propellant 14 housed within the gas generator 12.

The gas generator 12 contains a solid propellant 14 which on ignition generates a large volume of a high temperature gas containing fire suppressing fluids such as carbon dioxide, nitrogen, and water vapor. Depending on the selection of the vaporizable liquid and the type of fire anticipated as requiring suppression, the gas is generated for a period of time ranging from a few milliseconds to several seconds. One particularly suitable gas generator is the type used in automotive air bags. This type of gas generator is described in U.S. Pat. No. 3,904,221 to Shiki et al., which is incorporated by reference in its entirety herein. A housing 36 supports the solid propellant 14 and directs an explosive shock wave in the direction of the vaporizable liquid 18. Typical materials for the housing 36 include aluminum alloys and stainless steel.

The preferred solid propellant 14 is a combustible mixture which generates a copious amount of high temperature gas. The chemical reactions converting the propellant to the first gas generally do not occur efficiently at temperatures below about 2000° F. The gas yield in moles per 100 grams of propellant should be in excess of about 1.5 moles and preferably in excess of about 2.0 moles. The propellants are generally a mixture of a nitrogen rich fuel and an oxidizing agent in the proper stoichiometric ratio to minimize the formation of hydrogen and oxygen. The preferred fuels are azide and azole compounds.

Two preferred solid propellants are RRC-3110 and FS-01 (both available from Rocket Research Company of Redmond, Wash.) The compositions (in weight percent) of these propellants are:

| RRC-3110 | |
|---|---|
| 5-Aminotetrazole | 28.62% |
| Strontium nitrate | 57.38% |
| Clay | 8.00% |
| Potassium 5-Aminotetrazole | 6.00% |

When ignited, RRC-3110 generates $H_2O$, $N_2$, and $CO_2$ as well as SrO, $SrCO_3$, and $K_2CO_3$ particulate.

| FS-01 | |
|---|---|
| 5-Aminotetrazole | 29.20% |
| Strontium nitrate | 50.80% |
| Magnesium carbonate | 20.00% |

When ignited, FS-01 generates $H_2O$, $N_2$, and $CO_2$ as well as SrO, $SrCO_3$, and MgO particulate.

Two propellants which generate KCl salt are also suitable. KCl is effective in suppressing fires, but the corrosive nature of the salt limits the application of these propellants.

| | |
|---|---|
| 5-Aminotetrazole | 30.90% |
| Potassium perchlorate | 44.10% |
| Magnesium carbonate | 25.00% |

When ignited, this propellant generates $H_2O$, $N_2$, and $CO_2$ gas as well as KCl and MgO particulate.

| | |
|---|---|
| Potassium chlorate | 61.0% |
| Carbon | 9.0% |
| Magnesium carbonate | 30.0% |

When ignited, this propellant generates $CO_2$ as the only gas and KCl and MgO particulate.

Another suitable propellant generates nitrogen gas and solid slag which remains in the housing 36; only the gas is delivered to the vaporizable liquid eliminating contamination of the area by the solid particulates.

| | |
|---|---|
| Sodium azide | 59.1% |
| Iron oxide | 39.4% |
| Potassium nitrate | 1.0% |
| Carbon | 0.5% |

When ignited, this propellant generates $N_2$ gas and slag which is not discharged from the housing.

The propellants useful in the apparatus of the invention are not limited to the five specified above. Any solid propellant capable of generating similar gaseous products at high velocity and high temperature is suitable.

The solid propellant may be required to generate the gas over a time ranging from about 30 milliseconds to several seconds. Typically, a short "burn time" is required in an explosive environment while a longer burn time is required in a burning environment. If a short burn time is desired, the propellant is in the form of tablets, typically on the order of 1 centimeter in diameter by about one half centimeter thick. Increasing the pellet size increases the burn time. For a burn time of several seconds, the gas generator contains a single propellant slug compression molded into the housing 36.

To prevent the housing 36 from melting during ignition of the solid propellant 14, a cooling material 38 may be disposed between the housing 36 and solid propellant 14. One cooling material is granular magnesium carbonate which generates carbon dioxide when heated above 300° F. One mole of $MgCO_3$ will produce one mole of $CO_2$ plus one mole of MgO, which remains in the housing 36 in the form of a slag. Small amounts of MgO dust may be exhausted during ignition of the solid propellant.

To prevent contamination of the chamber 20 by the solid propellant 14 prior to ignition, a first rupture diaphragm 40 isolates the vaporizable liquid 18. The isolation diaphragm 40 is ruptured by the pressure of the shock wave. No active device such as a disk rupturing detonator is required. To prevent the generation of mechanical debris, the isolation diaphragm 40 may have score lines and hinge areas to open in a petal like fashion.

The first conduit 22 forms a passageway to communicate the first gas 16 to the vaporizable liquid 18. The first gas 16 is superheated and traveling at high velocity. Interaction of the first gas and the vaporizable liquid 18 vaporizes the liquid generating a second gas 24. The second gas 24 ruptures the second isolation diaphragm 42 and is expelled as a fire-suppressing gas, preferably through aspirator 28.

The selection of the vaporizable liquid 18 is based on a desire that the second gas 24 be less reactive with atmospheric ozone than Halon. The vaporizable liquid 18 contains no bromine, and preferably also no chlorine. Preferred groups of vaporizable liquids 18 include fluorocarbons, molecules containing only a carbon-fluorine bond, and hydrogenated fluorocarbons, molecules containing both carbon-hydrogen and carbon-fluorine bonds. Table 1 identifies preferred fluorocarbons and hydrogenated fluorocarbons and their vaporization temperatures. For comparison, the data for Halon 1301 is also provided.

TABLE 1

| System | Formula | Vaporization Temperature (°C.) | Vaporization Pressure Room Temperature (psi) |
|---|---|---|---|
| HFC-32 | $CH_2F_2$ | −52 | 120 |
| HFC-227 | $CF_3CHFCH_3$ | −15 | 59 |
| HCFC-22 | $CHCLF_2$ | −41 | 139 |
| HCFC-134A | $CF_3CH_2F$ | −27 | 83 |
| FC-116 | $CF_3CF_3$ | −78 | 465 |
| HCFC-124 | $CHCLFCF_3$ | −12 | 61 |
| HFC-125 | $CF_3CF_2H$ | −48 | 195 |
| FC-31−10 | $C_4F_{10}$ | −2 | — |
| FC-C318 | $(CF_2)_4$ | −4 | — |
| HF-23 | $CF_3H$ | −82 | 700 |
| HCFC-123 | $CF_3CCl_2H$ | −28 | 13 |
| FC-218 | $CF_3CF_2CF_3$ | −36 | 120 |
| HALON 1301 | $CF_3Br$ | −58 | 220 |

The most preferred fluorocarbons and hydrogenated fluorocarbons are those with the higher boiling points and lower vapor pressures. The higher boiling point reduces the pressure required to store the vaporizable liquid 18 as a liquid. The lower vapor pressures increase the rate of conversion of the vaporizable liquid he fire suppressing gas on ignition. Particularly suitable are HFC-227, FC-31-10, FC-318 and FC-218.

Unsaturated or alkene halocarbons have a low vapor pressure and a relatively high boiling point. These unsaturated molecules contain a carbon-carbon double bond, together with a carbon-fluorine bond, and in some cases, a carbon-hydrogen bond. The unsaturation causes these compounds to be considerably more photosensitive than a saturated species, leading to significant photochemical degradation in the lower atmosphere. The low altitude photodegradation may lessen the contribution of these compounds to stratospheric ozone depletion. Through the use of an unsaturated halocarbon in the fire suppression apparatus of the invention, it is possible that bromine containing compounds may be tolerated.

Representative haloalkenes have a boiling point of from about 35° C. to about 100° C. and include 3-bromo-3,3-difluoropropene, 3-bromo-1,1,3,3,tetrafluoropropene, 1-bromo-3,3,3-trifluoro-1-propene, 4-bromo-3,3,4,4,tetrafluoro-1-butene, and 4-bromo-3,4,4-trifluoro-3-(trifluormethyl)-1-butene, as well as homologues, analogs, and related compounds.

One disadvantage with the fluorocarbons and hydrogenated fluorocarbons, whether saturated or unsaturated, is the generation of small amounts of hydrogen fluoride when the vapor contacts a fire. Hydrogen fluoride is corrosive to equipment and hazardous to personnel. The significant heat and pressure conducted by the first gas 16 permits the use liquid carbon dioxide or water as the vaporizable liquid 18. The expansion problem identified above for nonenergetically discharged liquid carbon dioxide is eliminated by the superheating effect of the first gas 16. Water is converted to a fine mist of steam on interaction with the first gas and is highly effective for flame suppression.

Figure 2:
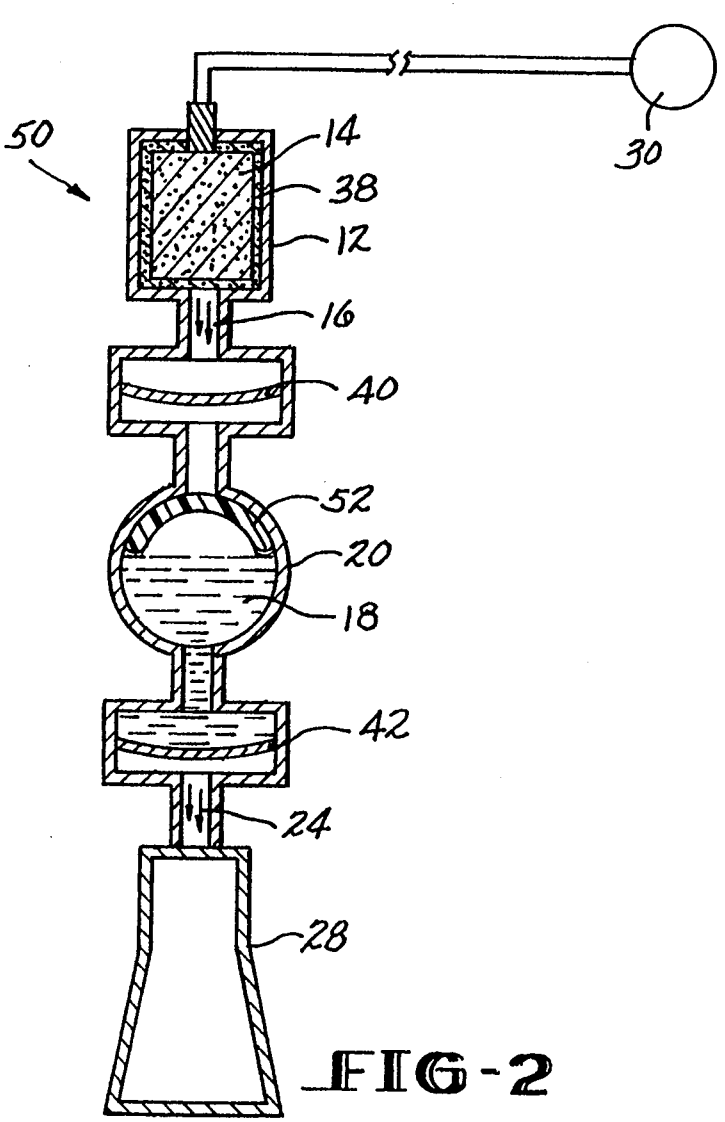
FIG. 2 illustrates in cross-sectional representation an apparatus for vaporizing a liquid to a flame suppressing gas in accordance with a second embodiment of the invention.

In a second embodiment of the invention, the fire suppression apparatus 50 is as illustrated in cross-sectional representation in FIG. 2. The elements of the second fire suppression apparatus 50 are substantially the same as those illustrated in FIG. 1 and like elements are identified by like Figure numerals. Typically the solid propellant 14 generates solid particulates along with the first gas. Particulates may be also be generated by other components of the fire suppression apparatus such as the magnesium carbonate cooling layer 38. If the environment in which the flame suppression apparatus 50 is located would be detrimentally affected by the presence of solid particulates, a bladder 52 may be disposed between the gas generator 12 and the chamber 20. The energetic first gas 16 forcedly deforms the flexible bladder 52, generating a shock wave vaporizing the vaporizable liquid 18 and generating the second gas 24. The bladder 52 may be any suitable material such as a high temperature elastomer.

This second embodiment does not superheat the vaporizable liquid 18 as effectively as the first embodiment. The transfer of heat through the elastomeric material 52 is limited. Accordingly, lower boiling point vaporizable liquids such as HFC-32, FC-116, and HF-23 are preferred.

Figure 3:
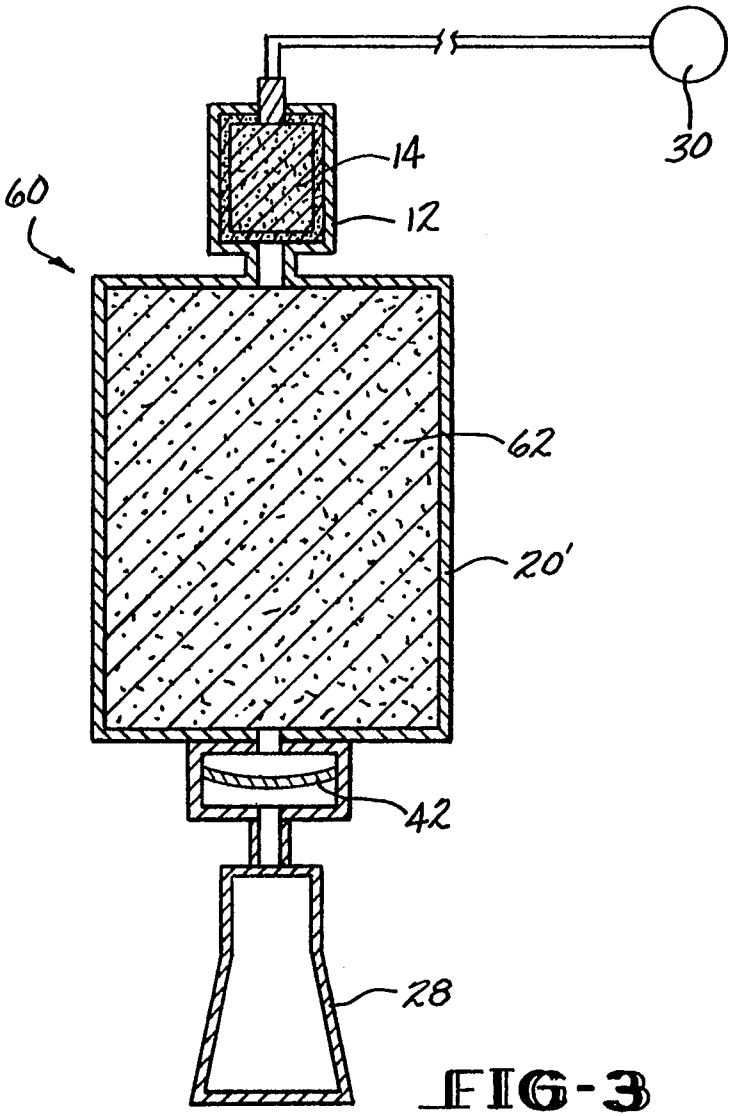
FIG. 3 illustrates in cross-sectional representation an apparatus for delivering a dry chemical flame suppressant to a fire.

In a third embodiment of the invention, a solid flame suppressant may be utilized as illustrated by the flame suppression apparatus 60 of FIG. 3. The flame suppression apparatus 60 illustrated in cross-sectional representation is similar to the earlier embodiments and like elements are identified by like reference numerals, while elements performing a similar function are identified by primed reference numerals. The chamber 20' is packed with small diameter, on the order of from about 5 to about 100 micron, and preferably from about 10 to about 50 micron, particles 62 of any effective flame suppressing material. Suitable materials include potassium bicarbonate, sodium bicarbonate, ammonium phosphate, potassium chloride, granular graphite, sodium chloride, sand, talc, powdered limestone, graphite powder, sodium carbonate, strontium carbonate, calcium carbonate, and magnesium carbonate. These and other suitable materials may be mixed with boron oxide as disclosed in U.S. Pat. No. 4,915,853 to Yamaguchi.

Figure 4:
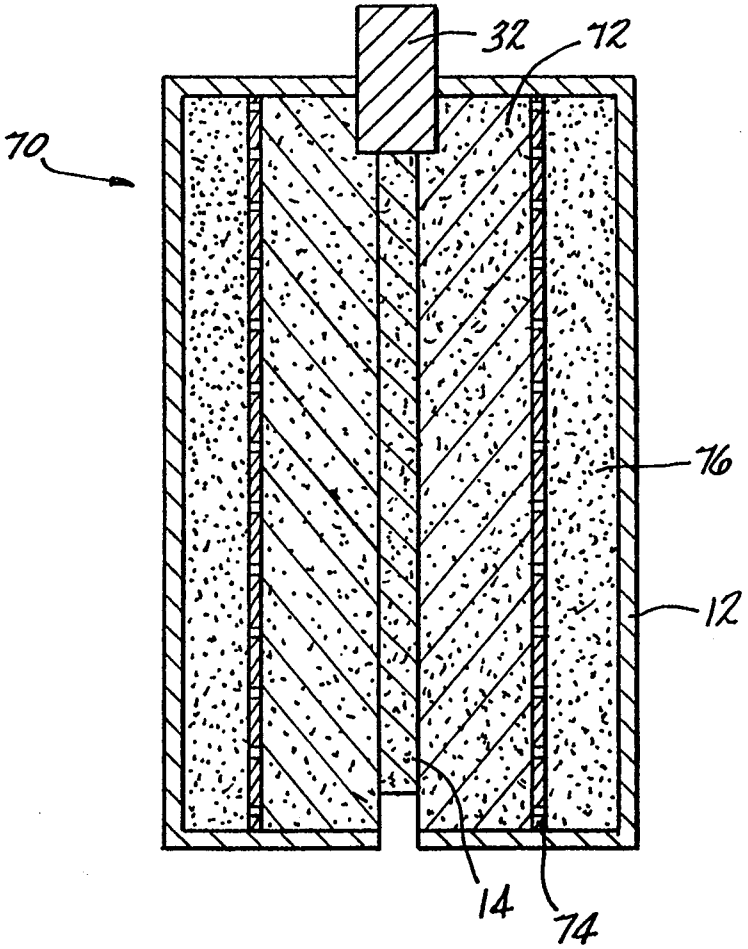
FIG. 4 illustrates in cross-sectional representation a carbon dioxide producing gas generator.

In the preceding embodiments of the invention, the flame suppression apparatus has been described in terms of a superheated gas interacting with a vaporizable liquid. The superheated gas is predominantly nitrogen, carbon dioxide, and water vapor, all effective fire suppressants. In certain applications, it is preferred to omit the vaporizable liquid and discharge the flame suppressing gases generated by the solid propellant directly onto the fire. A carbon dioxide producing gas generator 70 is illustrated in cross-sectional representation in FIG. 4.

The carbon dioxide producing gas generator 70 is similar to the gas generators described above. An electric squib 32 activates an energetic mixture of a solid propellant 14. On ignition, the solid propellant 14 ignites a magnesium carbonate containing propellant 72 generating MgO and $CO_2$. A perforated screen 74 separates the propellants from the housing 12. A magnesium carbonate cooling bed 76 is disposed between the housing 12 and the propellants and on heating generates additional $CO_2$.

The following model illustrates the effectiveness of the carbon dioxide generating system 70.

EXAMPLE

Gas Generator Characteristics
Length—16.63 inches
Diameter—5.50 inches
Displaced external volume—395 inch$^3$
$MgCO_3$ propellant lead—4.437 pound (generates 3.10 pounds $CO_2$)
$MgCO_3$ coolant lead—13.21 pound (generates 6.894 pounds $CO_2$)
Total $CO_2$ produced—10.00 pound
Estimated weight of total system—26.10 pounds.
Gas Generator Materials
Housing 12—Aluminum alloy 6061-T6
Solid propellant 14—$BKNO_3$
$MgCO_3$ propellant 72—in pellet form, size of pellets based on desired burn time, about 1 centimeter diameter by 0.5 centimeter thick tablets provide a 30 millisecond burn.
$MgCO_3$ coolant bed 76—granular
Perforated retaining screen 74 has 0.050 inch perforations.

This system will produce about 10 pounds of carbon dioxide, weigh about 26.10 pounds, and occupy 395 inch$^3$ of space. By comparison, a Halon 1301 system containing 10 pounds of fire suppressant weighs about 19 pounds and occupies 365 l inch$^3$ of space. While the system of the invention is sightly larger and heavier than the Halon system, other Halon replacement systems are predicted to increase the weight by a factor of 2 or 3.

The patents cited in this application are intended to be incorporated by reference.

It is apparent that there has been provided in accordance with this invention an apparatus and method for suppressing a fire which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the claims.

I claim:

1. An apparatus for suppressing a fire comprising:
(a) a gas generator comprising a housing supporting a mixture of a nitrogen-rich fuel and an oxidizing agent as a solid propellant that generates a high temperature gas selected from the group consisting of nitrogen, carbon dioxide, water vapor and mixtures thereof on ignition;
(b) magnesium carbonate disposed between said housing and said solid propellant;
(c) a conduit directing said high temperature gas to a chamber;
(d) a vaporizable liquid contained within said chamber that vaporizes on interaction with said high temperature gas; and
(e) a passageway between said chamber and said fire to deliver said vaporized liquid to said fire.

2. The apparatus of claim 1 wherein said nitrogen-rich fuel is 5-aminotetrazole.

3. The apparatus of claim 2 wherein said solid propellant is an effective mixture of 5-aminotetrazole, strontium nitrate, clay, and potassium 5-aminotetrazole.

4. The apparatus of claim 1 wherein said vaporizable liquid is selected from the group consisting of fluorocarbons, hydrogenated fluorocarbons, haloalkenes, carbon dioxide, water, and mixtures thereof.

5. The apparatus of claim 4 wherein said vaporizable liquid is a fluorocarbon having a boiling temperature above about −25° C. and a room temperature vaporization pressure above about 25 psi.

6. The apparatus of claim 5 wherein said vaporizable liquid is selected from the group consisting of $CF_3CHFCH_3$, $C_4F_{10}$, $(CF_2)_4$, and mixtures thereof.

7. The apparatus of claims 1 wherein said passageway includes an aspirator disposed between said chamber and said fire.

8. The apparatus of claim 7 wherein said conduit includes an isolation diaphragm disposed between said gas generator and said chamber.

* * * * *